US008388705B2

(12) United States Patent
Bollon et al.

(10) Patent No.: US 8,388,705 B2
(45) Date of Patent: Mar. 5, 2013

(54) USE OF LIQUEFIED GAS COMPOSITIONS

(75) Inventors: François Bollon, Noisy le Grand (FR); Pierre Schmelzle, Saint Julien Molin Molette (FR); Pascal Manuelli, Ectot l'Auber (FR)

(73) Assignee: Total Raffinage Marketing, Puteaux (FR)

( * ) Notice: Subject to any disclaimer, the term of this patent is extended or adjusted under 35 U.S.C. 154(b) by 192 days.

(21) Appl. No.: 12/682,312

(22) PCT Filed: Oct. 9, 2008

(86) PCT No.: PCT/FR2008/001416

§ 371 (c)(1),
(2), (4) Date: Apr. 9, 2010

(87) PCT Pub. No.: WO2009/083668

PCT Pub. Date: Jul. 9, 2009

(65) Prior Publication Data

US 2010/0281764 A1 Nov. 11, 2010

(30) Foreign Application Priority Data

Oct. 11, 2007 (FR) ..... 07 07126

(51) Int. Cl.
*C10L 1/18* (2006.01)

(52) U.S. Cl. ..... 44/448

(58) Field of Classification Search ..... 44/448
See application file for complete search history.

(56) References Cited

U.S. PATENT DOCUMENTS

| | | | | |
|---|---|---|---|---|
| 3,660,059 | A | 5/1972 | Hollemann et al. | |
| 6,202,601 | B1 | 3/2001 | Ouellette et al. | |
| 6,324,827 | B1 | 12/2001 | Basu et al. | |
| 6,584,780 | B2 | 7/2003 | Hibino et al. | |
| 6,607,567 | B1 * | 8/2003 | Towfighi | 44/448 |
| 6,800,104 | B2 * | 10/2004 | Rosenbaum | 44/448 |
| 6,896,794 | B2 | 5/2005 | Towfighi | |
| 2008/0050308 | A1 | 2/2008 | Vermeiren et al. | |

FOREIGN PATENT DOCUMENTS

| | | |
|---|---|---|
| JP | 60086195 | 5/1985 |
| WO | WO 99/00466 | 1/1999 |

* cited by examiner

*Primary Examiner* — Cephia D Toomer
(74) *Attorney, Agent, or Firm* — Harness, Dickey & Pierce, P.L.C.

(57) ABSTRACT

Use of a composition of liquefied gases for domestic use, containing dimethylether or DME in a mixture with at least one hydrocarbon with 3 carbon atoms and at least one hydrocarbon with 4 carbon atoms, in which the gaseous mixture released from storage contains a DME concentration fixed at a value of no more than 40 weight %.

12 Claims, 10 Drawing Sheets

USE OF LIQUEFIED GAS COMPOSITIONS

CROSS-REFERENCE TO RELATED APPLICATIONS

This application is a National Phase Entry of International Application No. PCT/FR2008/001416, filed on Oct. 9, 2008, which claims priority to French Application 0707126, filed on Oct. 11, 2007, both of which are incorporated by reference herein.

BACKGROUND AND SUMMARY

The present invention concerns the use of liquefied gases and compositions of liquefied gases, for domestic use. For this domestic application, a gas mixture composition must be provided that is capable of burning under the fuel mix conditions required by the burner either of a boiler or of a domestic cooker, for the uninformed user.

Since the quantity of fossil gases is on the decline and there is a risk of long-term shortage thereof, there is a need to find compounds capable of substituting for these fossil gases. However, the development of new sources of gaseous fuels, and hence of substitution compositions for fossil liquefied gases, requires that these sources do not bring a major change in the behaviour of liquefied gas compositions and that these compositions can still be directly used in existing installations. Therefore these new compositions must be stable when stored, like existing compositions, and above all must be capable of burning continuously, for domestic use of gas sold in bottles and intended to be used with conventional burners or any type of burner, to supply heating installations.

International application WO 99/00466 describes a substitute fuel for internal combustion engines consisting of a mixture of several miscible fuels, of which at least one has a high octane number and at least one has a high cetane number. One of these substitution fuels consists of a liquefied mix of at least 2 gases, one being self-igniting by compression, the other being a good oxidizer. According to one embodiment, this fuel consists of a mixture of liquefied petroleum gas (LPG) i.e. a mixture of hydrocarbons comprising no more than 4 carbon atoms, and dimethylether (DME) with high cetane number. The use of said fuel can limit particulate emissions through incomplete combustion and pollutant emissions, compared with conventional fuels.

European patent EP 928,326 describes the use, in a dry low $NO_x$ combustion system, of a fuel composition consisting of a mixture of three components: 15 to 93 weight % dimethylether, 7 to 85 weight % of at least one alcohol and no more than 50 weight % of a component chosen from the group consisting of water and C1 to C6 alkanes. According to one particular embodiment, the third component is chosen from among water, methane, propane and liquefied petroleum gas. This combustion chamber is intended to supply a turbine for power production.

U.S. Pat. No. 6,202,601 describes a method to inject two gaseous fuels into a cylinder of a combustion engine, one being the primary fuel and the other being the pilot fuel which self ignites more readily than the primary fuel. The primary fuel is chosen from among natural gas, liquefied petroleum gas, biogas, landfill gas and hydrogen gas, and the pilot fuel is dimethylether. According to one particular embodiment of the method, the primary fuel and the pilot fuel are added separately to the engine, the primary fuel during a first stage, the pilot fuel during a second stage, these stages corresponding to different load operating modes of the engine.

Japanese patent application JP 60086195 describes a gaseous fuel composition obtained by incorporating dimethylether (DME) in a mixture of alkane and alkylene hydrocarbons containing 3 to 4 carbon atoms, to the proportion of 5-30 parts by weight DME in 100 parts by weight hydrocarbons: this mixture has good storage stability and good combustion properties. According to one particular embodiment, the 2 components, after being respectively liquefied, are mixed together before being added to the gas bottle. The gaseous composition comprises propane, n-butane or i-butane, but preferably propane alone with dimethylether or diethylether. This latter mixture notably has improved storage stability and improved combustion characteristics. It is even specified that this mixture is uniform and is able to burn continuously without interruption, and it therefore lends itself to use as fuel for industries or domestic applications.

It has now been found, and is the subject of the present invention, that liquefied gases containing dimethylether or DME in a mixture with at least one hydrocarbon compound with 3 carbon atoms and at least one hydrocarbon compound with 4 carbon atoms can improve storage stability whilst maintaining combustion properties close to those of a liquefied LPG gas. Contrary to the disclosure in Japanese patent JP 60086195, DME cannot be used alone with propane since the propane is consumed first, and when it is consumed DME becomes the majority component and the flame goes out. When used alone with butane, DME is the first to vaporize, and ignition and flame stability give rise to problems. In addition, to obtain regular combustion, it is preferable not to exceed the maximum concentration of 40% DME in the gas so that combustion in air is full and regular. However, if burners which can adjust the quantity of air could be provided for domestic use, optimization of parameters could allow more DME to be incorporated, up to 59 or 60% in the evaporated phase.

The subject of the present invention is therefore the use of a composition of storable liquefied gases containing dimethylether or DME in a mixture with a hydrocarbon mixture containing at least one hydrocarbon with 3 carbon atoms or propane and at least one hydrocarbon with 4 carbon atoms or butane, in which the gaseous mixture released after storage contains a constant DME concentration, fixed at a value of no more than 50 weight DME, until more than 50 weight % of the stored composition has been released. Therefore, said compositions can substitute for fossil liquefied gases currently available on the market for domestic use, in all types of existing burners, or even for use in an engine with combustion remaining constant and stable.

Preferably, in the use of the invention, the DME content in the released gaseous mixture is fixed at a value varying from 5 to 30 weight %. Preferably, in the use of the invention, the DME concentration is kept constant until more than 60 weight % of the stored gaseous mixture has been released. Preferably, in the use of the invention the initial gaseous mixture comprises 10 to 30 weight % DME, 20 to 50% propane and 50 to 20% butane. Preferably, in the use of the invention, the composition of liquefied gases has a DME/butane ratio of no more than 7 in the initial liquid mixture. Preferably, in the use of the invention, the composition of liquefied gases has a DME/propane ratio of no more than 6 in the initial liquid mixture.

Preferably, in the use of the invention, the composition of liquefied gases has DME/propane and DME/butane ratios which vary from 0.5 to 2. Preferably, in the use of the invention, the initial liquid mixture comprises 5 to 40 weight % DME, 5 to 91% propane and 90 to 4% butane. Preferably, in the use of the invention, the composition of liquefied gases is obtained from liquefied gases of commercial DME, butane, propane type. Preferably, the use according to the invention of the composition of liquefied gases is intended for the supply of domestic appliances, boilers, cookers and heating appliances in particular which operate by combustion in the presence of air, irrespective of the burner used. Preferably, the composition of liquefied gases is stored in a pressurized enclosure, of bottle or tank type.

By hydrocarbons with 3 carbon atoms is meant normal propane and isopropane, hereafter propane. By hydrocarbons with 4 carbon atoms is meant normal butane and isobutane, hereafter butane. By maintaining the DME concentration constant in the gaseous mixture on release from storage, in a preferred embodiment of the invention, is meant the ensuring of this concentration until more than 60 weight % of the gaseous mixture has been consumed.

The function of propane is to ensure the start of combustion and to ensure its stability, in general propane preferably burning before the DME and butane. The function of butane, burning after the DME, is to ensure continuous evaporation of the DME until its complete elimination from the storage, the butane ensuring maintaining of the flame. Evidently, the liquefied gas of the invention may contain other components such as the sub-products of DME synthesis, which are water and methanol. Therefore by "commercial" DME is meant a product containing at least 95% DME. By "commercial" propane is meant a mixture of hydrocarbons to the approximate proportion of 90% propane and propene, and the remainder being ethane, ethylene, butanes and butenes. By "commercial" butane is meant a mixture of hydrocarbons chiefly consisting of butanes and butenes and containing less than 19% by volume of propane and propene.

To obtain a constant DME concentration in the gaseous mixture, and to maintain good combustion stability and good heating value of the whole, it is necessary to adjust the DME/propane and DME/butane ratios in the gaseous mixture i.e. mixtures of liquefied gases in the storage capacity. Preferably DME/butane ratios of no more than 7 and DME/propane ratios of no more than 6 are chosen in the initial liquid mixture. Preferably, the DME/butane and DME/propane ratios vary between 0.5 and 2. In one preferred embodiment of the invention, the gas mixture placed in storage comprises 5 to 40 weight % DME, 5 to 91 weight % propane and 4 to 90 weight % butane. Preferably, it comprises 10 to 30 weight % DME, 20 to 50 weight % propane and 50 to 20 weight % butane.

One advantage of the liquid compositions of liquefied gases used according to the invention is their storage stability. Measurements taken on different proportions of mixtures over a period of 52 days showed no composition change. The storage of the liquefied gases used according to the invention can use conventional methods such as bottles, cylinders, containers, reservoirs or tanks intended for the storage of pressurized gases and/or liquids. Filling is carried out following usual methods. According to one preferred embodiment, the liquefied gases and compositions described above are used to supply a domestic appliance, in particular boilers, cookers and heating appliances operating by combustion in the presence of air, irrespective of the burner used. It can also be contemplated to use the above-described liquefied gas and liquefied gas compositions for the supply of internal combustion engines, notably of vehicles using on-board stored liquefied gas.

DETAILED DESCRIPTION

The following examples illustrate the present invention.

Example 1

Five compositions of liquefied gases containing DME were tested and are described in Table 1 below:

TABLE 1

| (wt. %) | E1 | E2 | E3 | E4 | E5 |
|---|---|---|---|---|---|
| n-Propane (nC3) | 66.2 | 73.5 | 4.8 | 5.8 | 21 |
| n-butane (nC4) | 0.5 | 2.5 | 40.9 | 50.1 | 49 |
| i-butane | 0.6 | 2.0 | 14.8 | 17.1 | |
| DME | 32.2 | 22 | 39.4 | 26.4 | 30 |
| Other (water/methanol . . .) | 0.5 | 0 | 0.1 | 0.6 | 0 |

They were prepared in 13 kg gas bottles for domestic use by merely weighing the weight quantities of each of the added products which were analyzed at initial time by connecting the pressure reducer of the bottle to a gaseous phase chromatograph to measure the respective concentrations of DME, butane and propane either in liquid phase with the bottle upturned, or in gaseous phase with the bottle positioned upright.

The change in the liquid compositions under storage conditions without any withdrawal of gas was analyzed. The results are grouped together in Table 2 below:

TABLE 2

| | (weight %) | E1 | E2 | E3 | E4 |
|---|---|---|---|---|---|
| Day 10 | DME | 31.7 | 21.5 | 37.9 | 31.2 |
| | i-C4 | 1.9 | 2.0 | 15.0 | 16.6 |
| | n-C4 | 2.4 | 2.5 | 42.4 | 46.6 |
| | n-C3 | 63.4 | 72.9 | 4.5 | 5.3 |
| Day 52 | DME | 31.7 | 21.6 | 38.2 | 31.1 |
| | i-C4 | 1.9 | 2.1 | 15.0 | 16.7 |
| | n-C4 | 2.4 | 2.5 | 42.1 | 46.8 |

Figure 1:
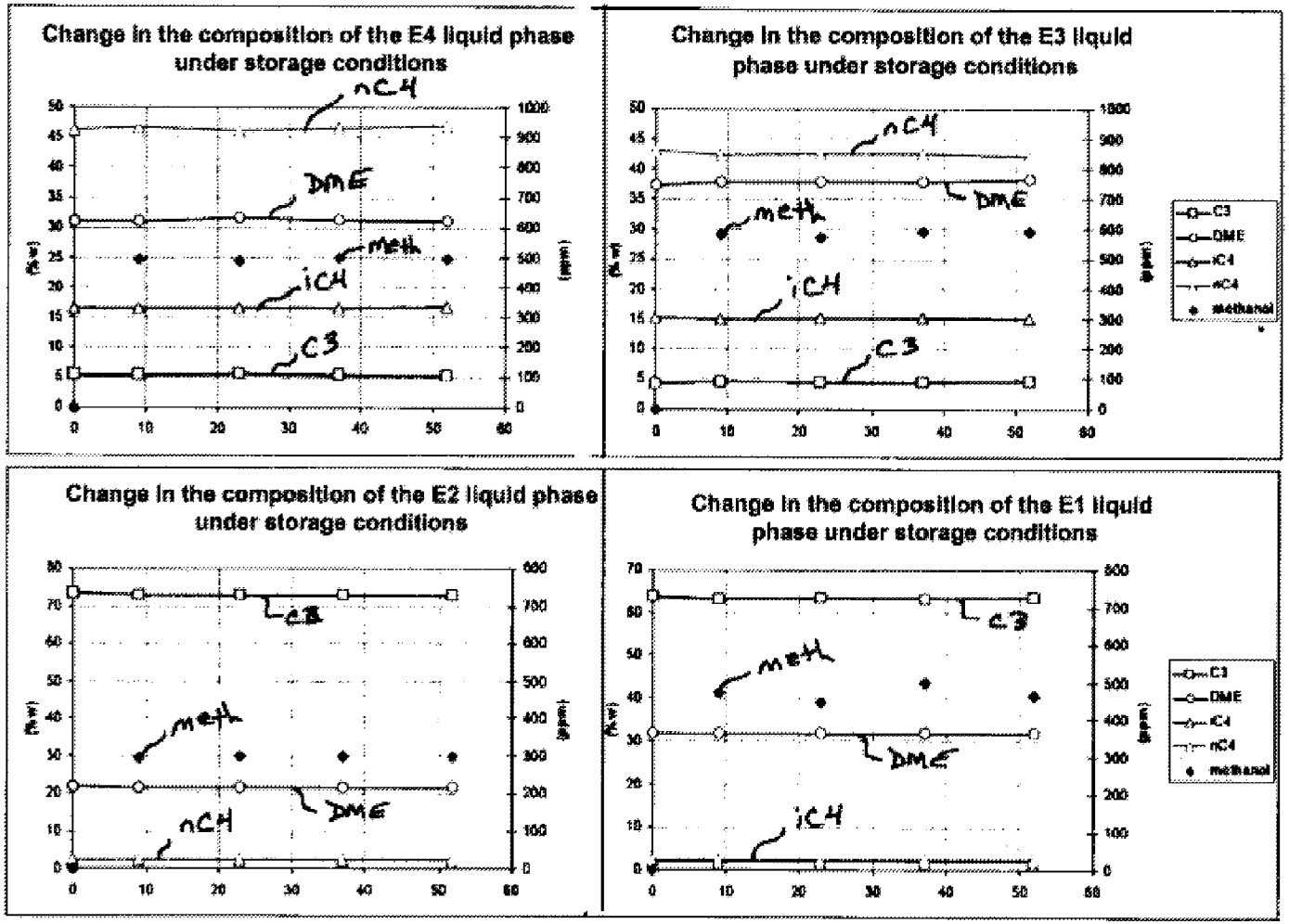
FIG. 1 is a set of graphs showing a change in the composition of the liquid phase under storage conditions.

The results show that no notable change in the composition of the liquid phase could be observed under the storage conditions (see also FIG. 1).

Example 2

This example concerns the change in DME composition in the gas compositions during use.

Compositions with High Butane Content

A/ Release of E3 Mixture. Gas Release Rate: 0.9 kg/h.

Figure 2:
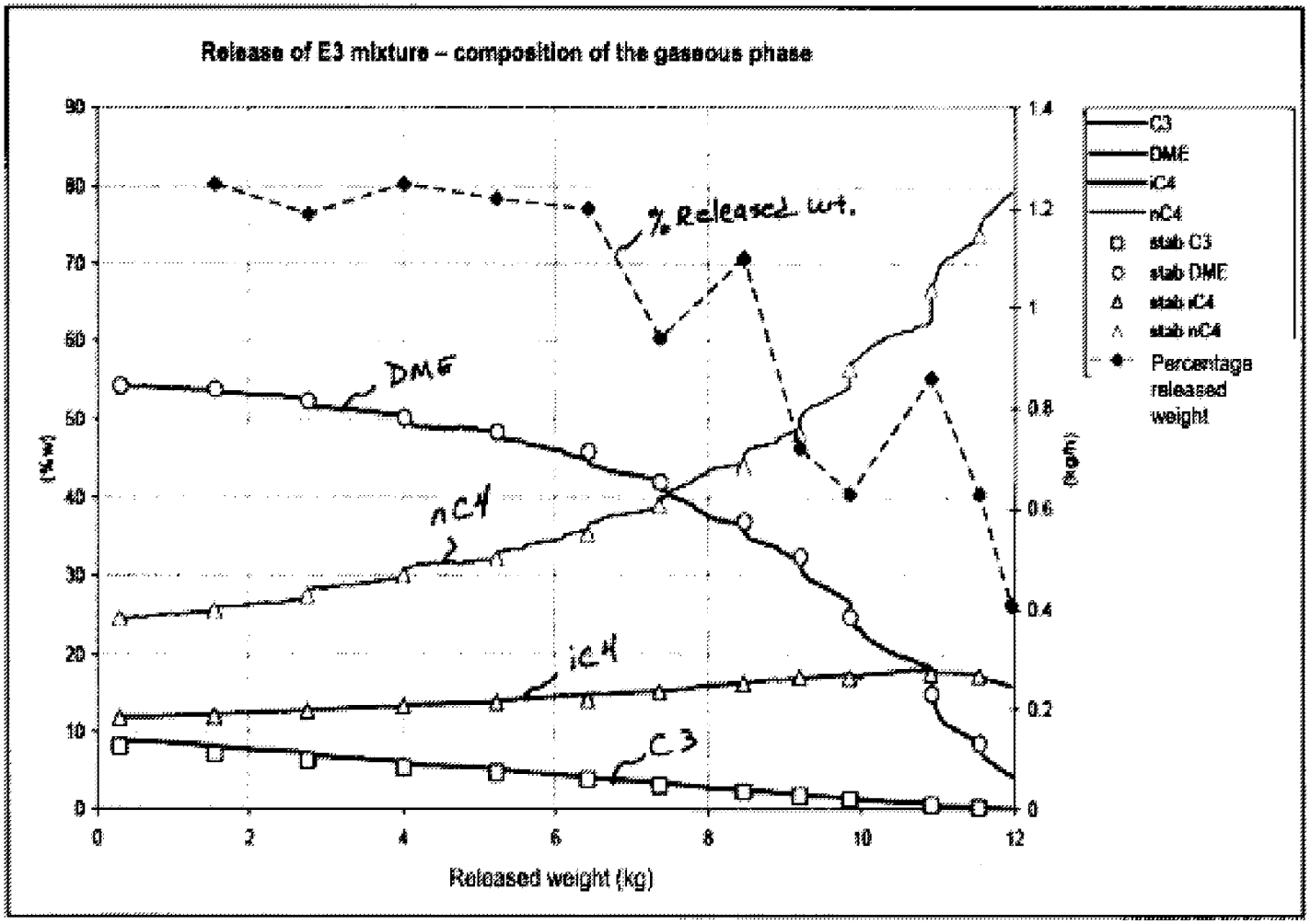
FIG. 2 is a graph showing a release of mixture-composition of the gaseous phase.

Composition of the Gaseous Phase (FIG. 2)

TABLE 3 composition of E3 gaseous phase

| | Initial gas composition (weight %) | End gas composition (weight %) |
|---|---|---|
| Propane (C3) | 9.1 | 0.4 |
| Dimethylether DME | 54.3 | 8.5 |
| Iso-butane (i-C4) | 11.9 | 17.3 |
| n-butane (n-C4) | 24.7 | 73.7 |

Figure 3:
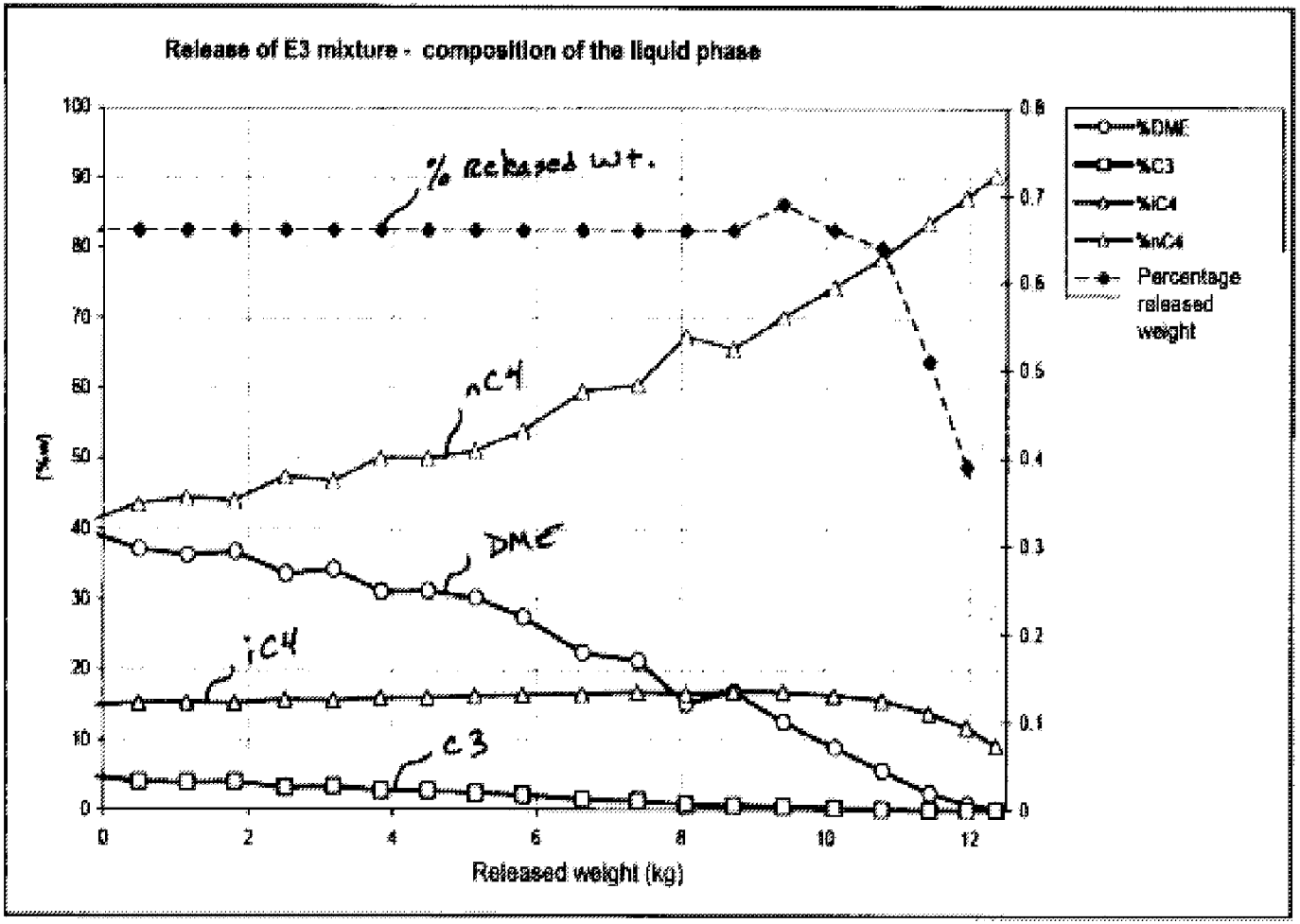
FIG. 3 is a graph showing a release of mixture-composition of the liquid phase.

Composition of the Liquid Phase (FIG. 3)

TABLE 4 composition of E3 liquid phase

| | Initial liquid composition (weight %) | End liquid composition (weight %) |
|---|---|---|
| Propane (C3) | 4.8 | 0.04 |
| Dimethylether DME | 39.4 | 0.20 |
| Iso-butane (i-C4) | 14.8 | 9.30 |
| n-butane (n-C4) | 40.9 | 90.40 |

B/ Release of E4 Mixture. Gas Release Rate: 0.9 kg/h.

Figure 4:
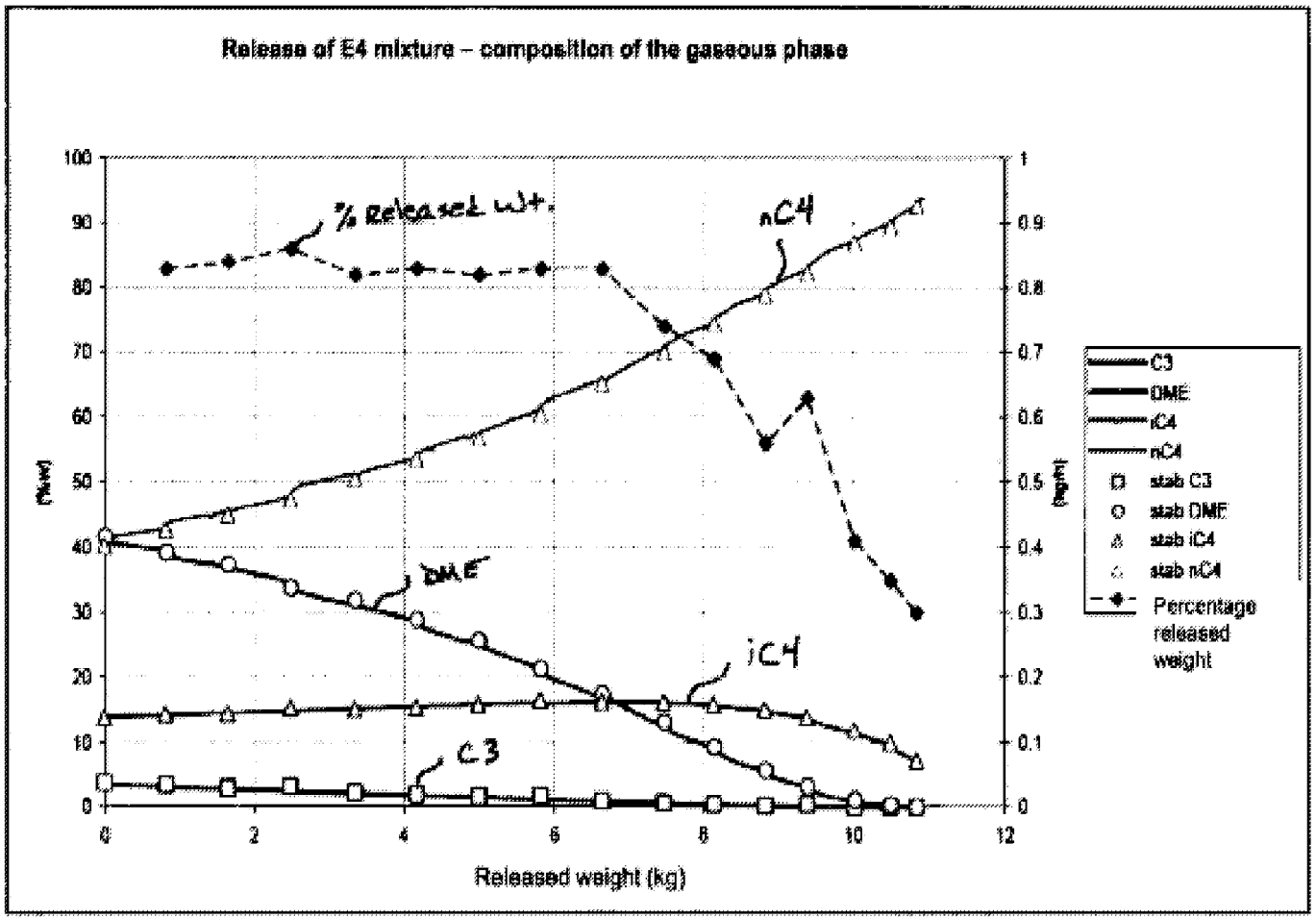
FIG. 4 is a graph showing a release of mixture-composition of the gaseous phase.

Composition of the Gaseous Phase (FIG. 4)

TABLE 5 composition of E4 gaseous phase

| | Initial gas composition (weight %) | End gas composition (weight %) |
|---|---|---|
| Propane (C3) | 3.9 | 0.07 |
| Dimethylether DME | 41.8 | 0.12 |
| Iso-butane (i-C4) | 13.9 | 7.20 |
| n-butane (n-C4) | 40.4 | 92.60 |

Figure 5:
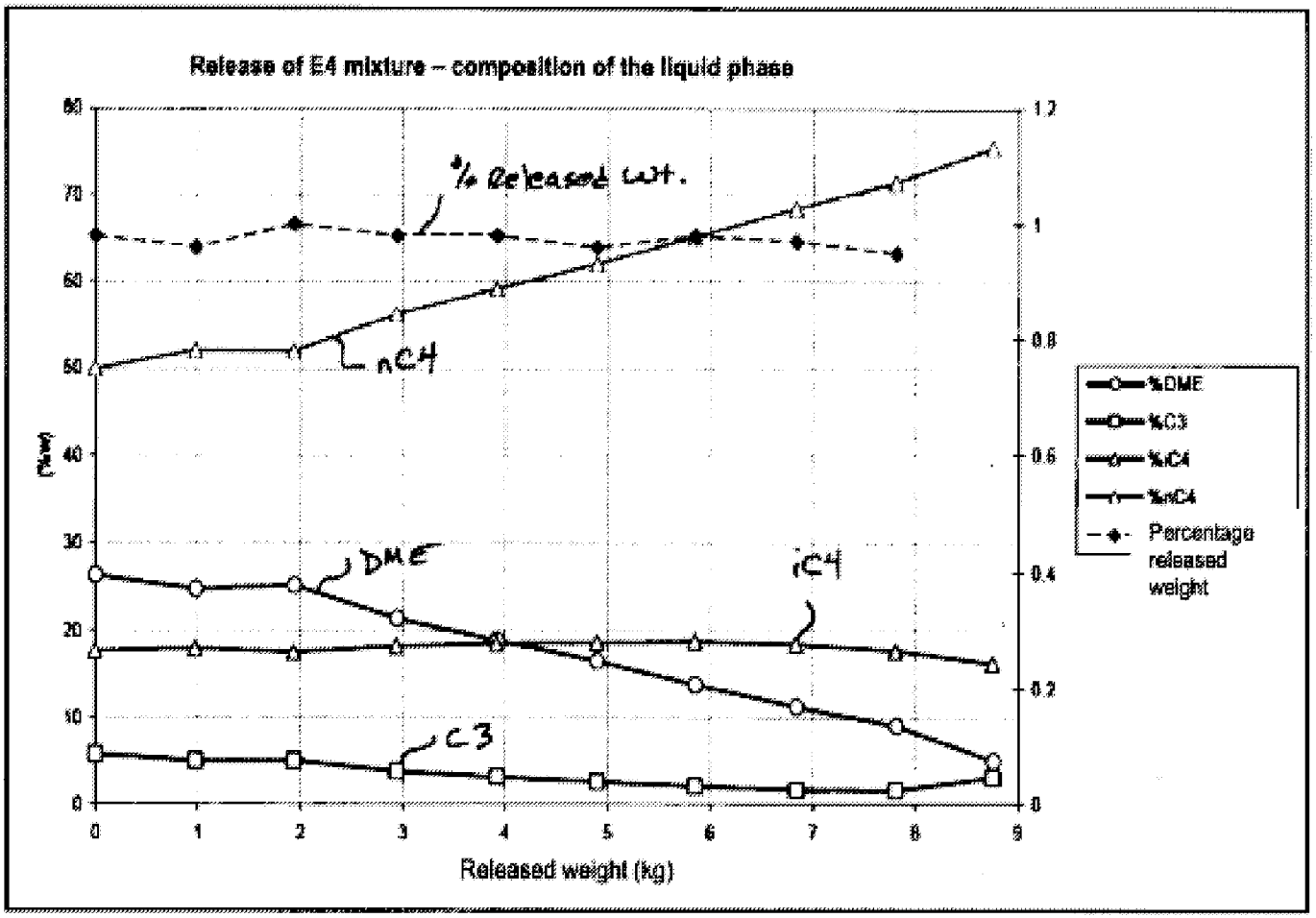
FIG. 5 is a graph showing a release of mixture-composition of the liquid phase.

Composition of the Liquid Phase (FIG. 5)

TABLE 6 composition of E4 liquid phase

| | Initial liquid composition (weight %) | End liquid composition (weight %) |
|---|---|---|
| Propane (C3) | 5.8 | 3.1 |
| Dimethylether DME | 26.4 | 5.1 |
| Iso-butane (i-C4) | 17.7 | 16.3 |
| n-butane (n-C4) | 50.1 | 75.5 |

Compositions with High Propane Content

A/ Release of E1 Mixture. Gas Release Rate: 1.2 kg/h and 0.6 kg/h for Last 2 kg.

Figure 6:
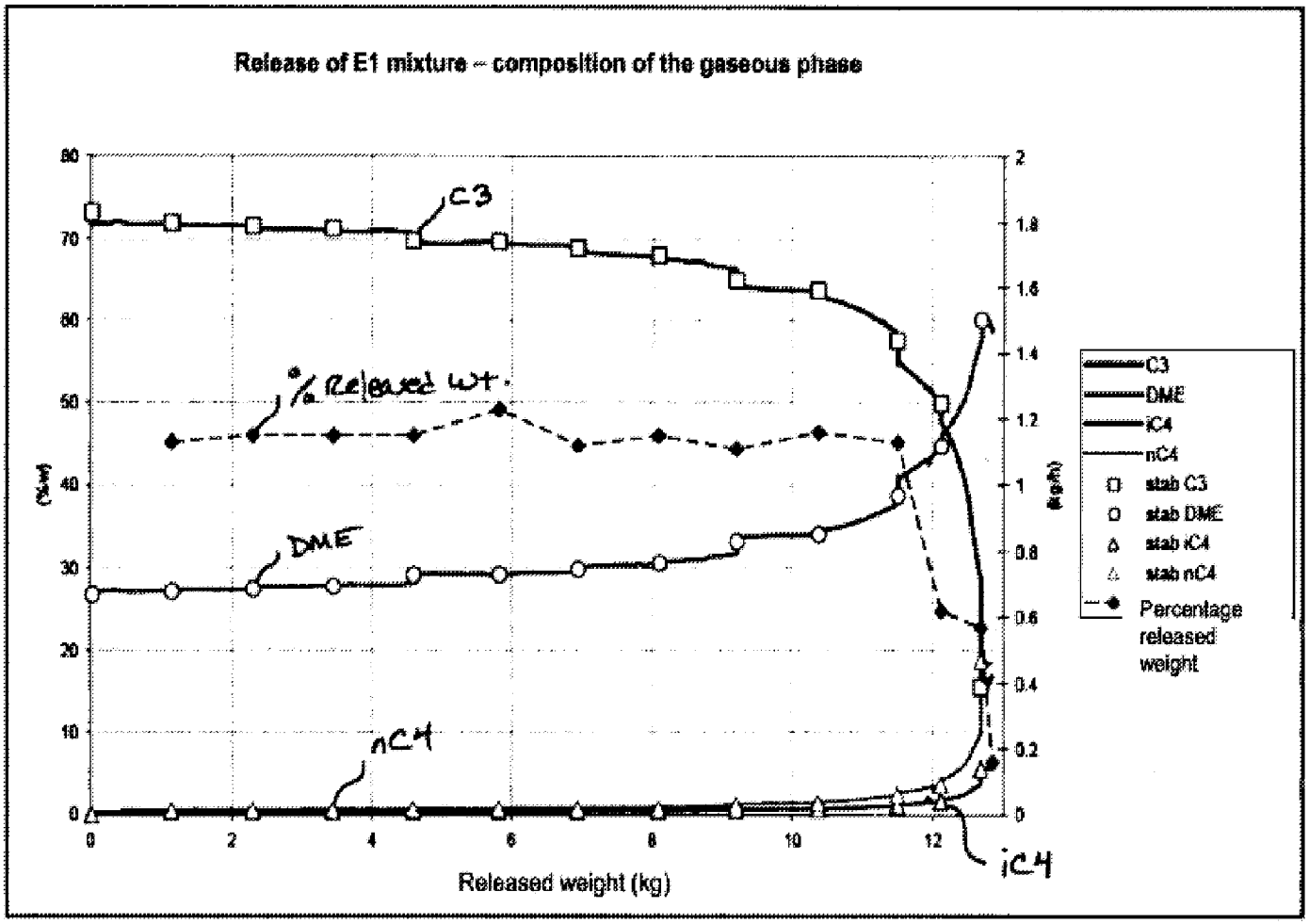
FIG. 6 is a graph showing a release of mixture-composition of the gaseous phase.

Composition of the Gaseous Phase (FIG. 6)

TABLE 7 composition of E1 gaseous phase

| | Initial gas composition (weight %) | End gas composition (weight %) |
|---|---|---|
| Propane (C3) | 73.2 | 15.5 |
| Dimethylether DME | 26.8 | 60.2 |
| Iso-butane (i-C4) | <1 | 5.6 |
| n-butane (n-C4) | <1 | 18.7 |

Figure 7:
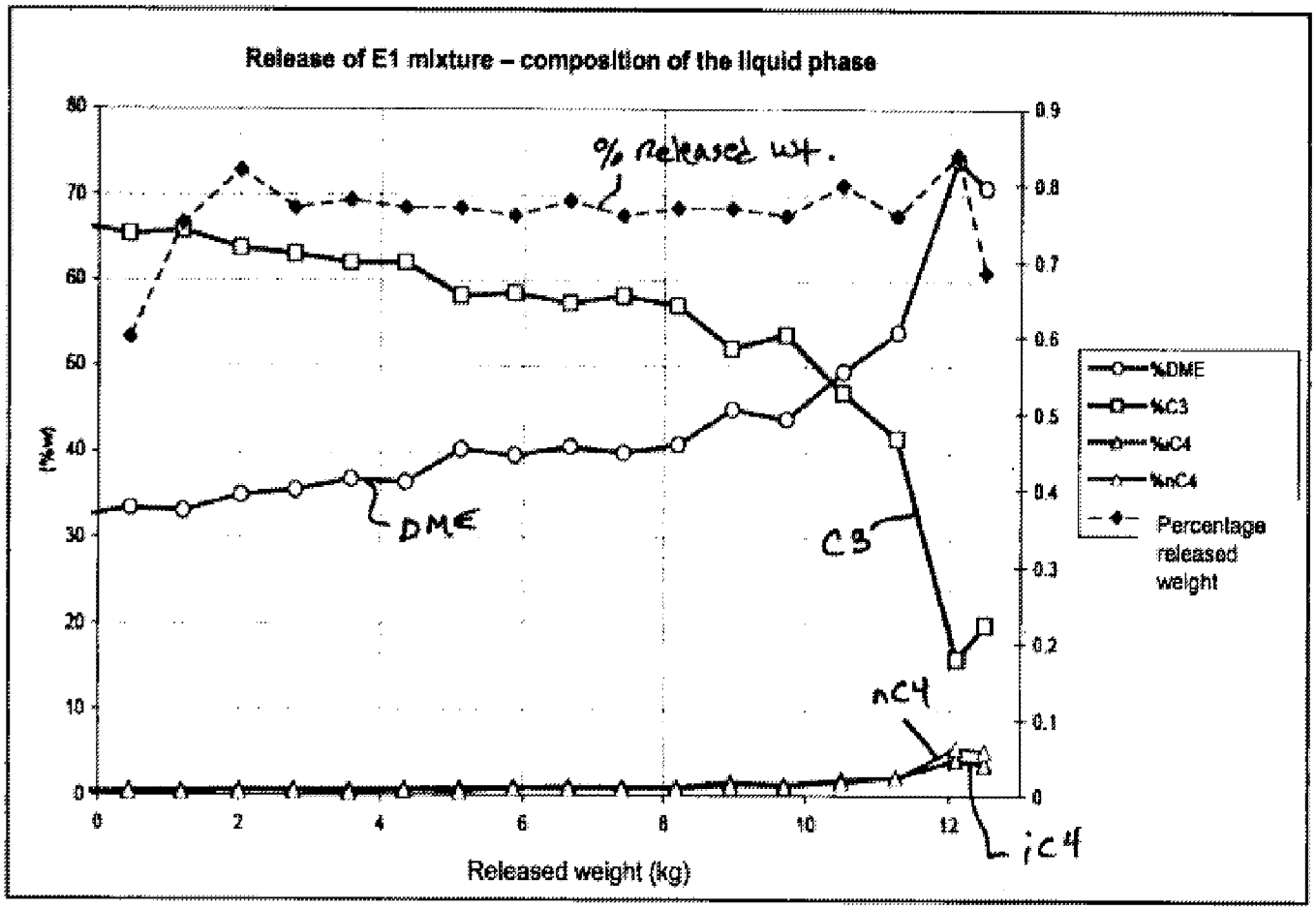
FIG. 7 is a graph showing a release of mixture-composition of the liquid phase.

Composition of the Liquid Phase (FIG. 7)

TABLE 8 composition of E1 liquid phase

| | Initial liquid composition (weight %) | End liquid composition (weight %) |
|---|---|---|
| Propane (C3) | 66.2 | 20 |
| Dimethylether DME | 32.7 | 70.9 |
| Iso-butane (i-C4) | 0.6 | 3.8 |
| n-butane (n-C4) | 0.5 | 5.3 |

B/ Release of the E2 Mixture. Gas Release Rate: 1.2 kg/h and 0.6 kg/h for Last 2 kg.

Figure 8:
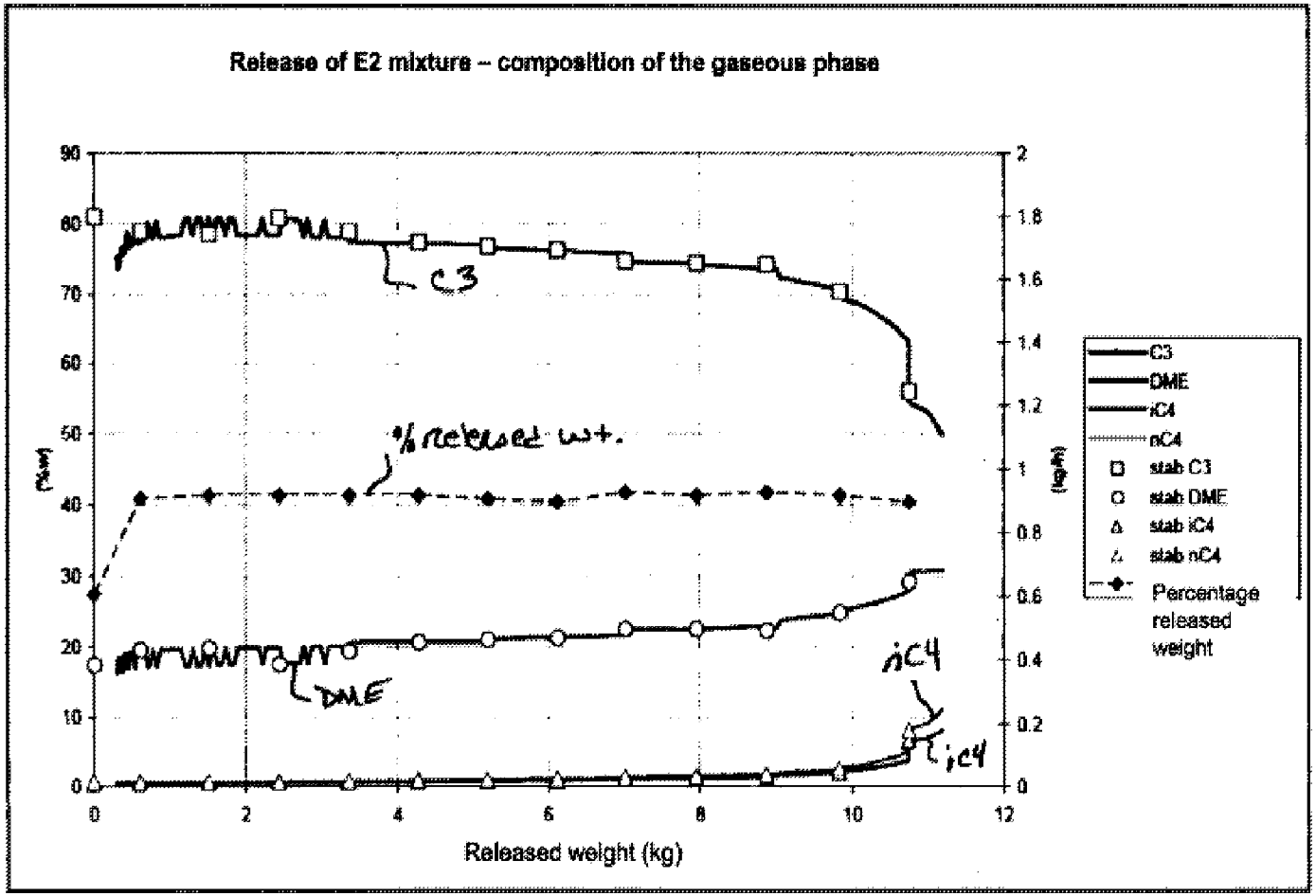
FIG. 8 is a graph showing a release of mixture-composition of the gaseous phase.

Composition of the Gaseous Phase (FIG. 8)

TABLE 9 composition of E2 gaseous phase

| | Initial gas composition (weight %) | End gas composition (weight %) |
|---|---|---|
| Propane (C3) | 81 | 50 |
| Dimethylether DME | 17.4 | 32 |
| Iso-butane (i-C4) | 0.7 | 8 |
| n-butane (n-C4) | 0.9 | 10 |

Figure 9:
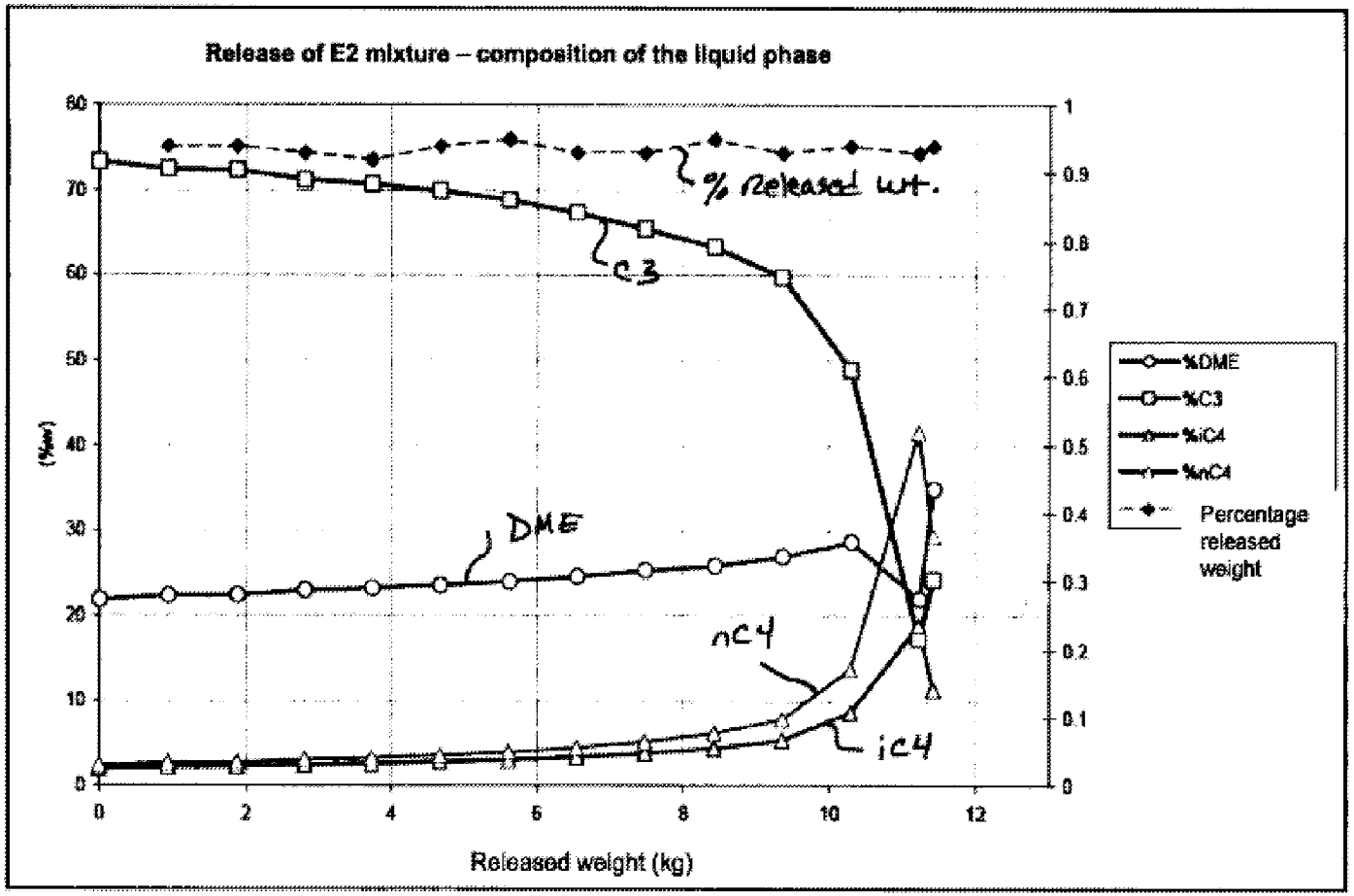
FIG. 9 is a graph showing a release of mixture-composition of the liquid phase.

Composition of the Liquid Phase (FIG. 9)

TABLE 10 composition of E2 liquid phase

| | Initial liquid composition (weight %) | End liquid composition (weight %) |
|---|---|---|
| Propane (C3) | 73.50 | 24.3 |
| Dimethylether DME | 22.00 | 34.9 |
| Iso-butane (i-C4) | 2.02 | 11.4 |
| n-butane (n-C4) | 2.50 | 29.4 |

Compositions with Average Propane and Butane Contents

Figure 10:
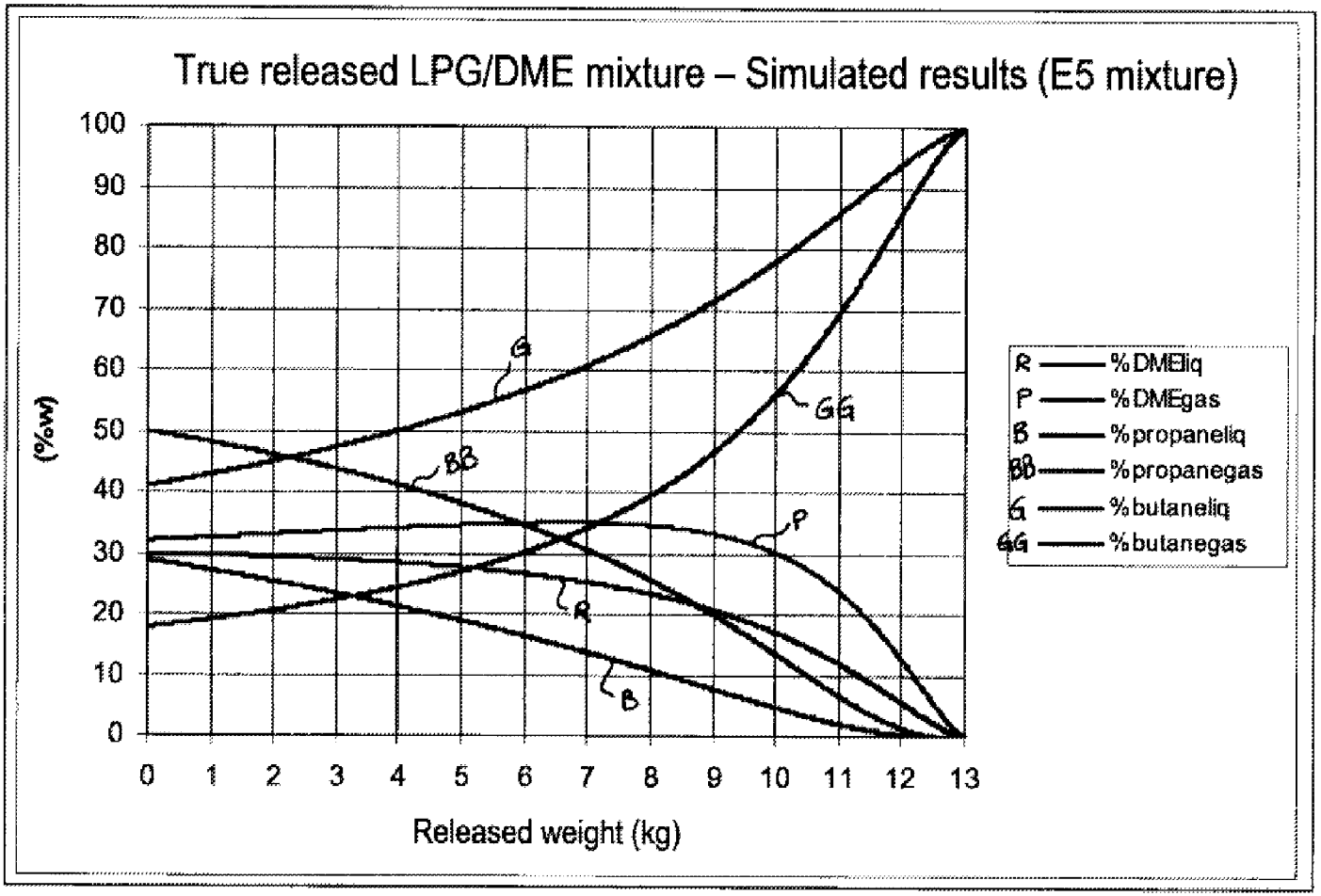
FIG. 10 is a graph showing a true released LPG/DME mixture.

These are compositions such as E5 corresponding to FIG. 10.

Composition of the Gaseous Phase:

TABLE 11

Composition of E2 gaseous phase

| | Initial gas composition (weight %) | End* gas composition (weight %) |
|---|---|---|
| Propane (C3) | 50 | 0 |
| Dimethylether DME | 32 | 14 |
| butane total (C4) | 18 | 86 |

Composition of the Liquid Phase:

TABLE 12

| Composition of E2 liquid phase | | |
|---|---|---|
| | Initial liquid composition (weight %) | End* liquid composition (weight %) |
| Propane (C3) | 30 | 0 |
| Dimethylether DME | 30 | 6 |
| butane total (C4) | 40 | 94 |

*when 12 kg of gas have been consumed.

Analysis of Results

Irrespective of the initial compositions of these different mixtures, during gas release very different changes are observed in the compositions of the two phases. In the best case, according to the invention, E5, firstly a reduction in propane concentration is observed, followed by a reduction in the concentration of DME and finally an increase in butane concentration. However, when it is desired to maintain a DME concentration of less than 40 weight % in the gaseous mixture leaving the bottle, it is immediately ascertained that some compositions high in butane such as E3 are unable to meet this constraint (see table 3 in which the initial DME concentration in the gas is more than 50%, this concentration being very slowly reduced in the mixture (see FIG. 2) and which contains little propane (around 4.8 weight in the initial mixture). Mixtures of E4 type are required in order to meet this constraint, in which the propane concentration is approximately 6 weight %. To meet this same constraint regarding DME concentration in the gas, whether in the initial mixture or end mixture, in mixtures high in propane such as E1 it is necessary to add a minimum amount of butane to the gaseous mixture. If the butane content in E1 is less than 4 weight % in the liquid, the gaseous mixture at the end of evaporation is increased to a DME concentration of up to 60%, which does not promote safe combustion. On the other hand, with a butane content of more than 4% in E2, the gaseous phase contains less than 40 weight % DME.

The invention claimed is:

1. A method for combusting a gas comprising the steps of:

providing a storable composition of liquefied gases containing dimethylether (DME) in a mixture with a hydrocarbon mixture containing at least propane and at least butane, adjusting DME/propane and DME/butane ratios in the composition of liquefied gases in order to release, on leaving storage of said composition, a gaseous mixture containing a constant DME concentration fixed at a value of no more than 50 weight % DME until more than 50 weight % of the stored composition has been released, and combusting the gaseous mixture containing the constant DME concentration in the presence of air.

2. The method of claim 1, wherein the DME content in the released gaseous mixture is fixed at a value varying between 5 and 30 weight %.

3. The method of claim 1, wherein the DME concentration is maintained constant up until more than 60 weight % of the stored gaseous mixture has been released.

4. The method of claim 1, wherein the gaseous mixture comprises 10 to 30 weight % DME, 20 to 50 weight % propane and 50 to 20 weight % butane.

5. The method of claim 1 wherein the storable composition of liquefied gases has a DME/butane ratio of no more than 7.

6. The method of claim 1, wherein the storable composition of liquefied gases has a DME/propane ratio of no more than 6.

7. The method of claim 1, wherein the storable composition of liquefied gases has DME/propane and DME/butane ratios which vary from 0.5 to 2.

8. The method of claim 1, wherein the storable composition of liquefied gases comprises 5 to 40 weight % DME, 5 to 91% propane and 90 to 4% butane.

9. The method of claim 1, wherein the storable composition of liquefied gases is obtained from liquefied gases of commercial DME, butane, or propane.

10. The method of claim 1 for the supply of domestic appliances, consisting of at least one of the following: boilers, cookers and heating appliances, operating by combustion in the presence of air, irrespective of the burner used.

11. The method of claim 1, wherein the storable composition of liquefied gases is stored in a pressurized bottle or tank.

12. The method of claim 1, wherein the gaseous mixture comprises 10 to 30 weight % DME, 20 to 50 weight % propane and 50 to 20 weight % butane and the storable composition of liquefied gases comprises 5 to 40 weight % DME, 5 to 91% propane and 90 to 4% butane.

* * * * *